US006935930B2

(12) United States Patent
Fujita

(10) Patent No.: US 6,935,930 B2
(45) Date of Patent: Aug. 30, 2005

(54) POLISHING APPARATUS AND METHOD, AND WAFER EVACUATION PROGRAM

(75) Inventor: Takashi Fujita, Mitaka (JP)

(73) Assignee: Tokyo Seimitsu Co., Ltd., Mitaka (JP)

( * ) Notice: Subject to any disclaimer, the term of this patent is extended or adjusted under 35 U.S.C. 154(b) by 0 days.

(21) Appl. No.: 10/464,458

(22) Filed: Jun. 19, 2003

(65) Prior Publication Data

US 2003/0236057 A1 Dec. 25, 2003

(30) Foreign Application Priority Data

Jun. 19, 2002 (JP) ..... 2002-178236

(51) Int. Cl.[7] ..... B24B 7/00
(52) U.S. Cl. ..... 451/41; 451/8
(58) Field of Search ..... 451/8, 41, 54, 451/64

(56) References Cited

U.S. PATENT DOCUMENTS 5,527,390 A * 6/1996 Ono et al. ..... 118/719
5,788,448 A * 8/1998 Wakamori et al. ..... 414/222.02
6,335,286 B1 1/2002 Lansford
6,343,239 B1 * 1/2002 Toda et al. ..... 700/121
6,406,589 B1 * 6/2002 Yanagisawa ..... 156/345.3
6,578,589 B1 * 6/2003 Mayusumi et al. ..... 134/61
6,654,698 B2 * 11/2003 Nulman ..... 702/85
2003/0092261 A1 * 5/2003 Kondo et al. ..... 438/638

FOREIGN PATENT DOCUMENTS

EP 0 806 265 A1 11/1997
EP 1 155 778 A2 11/2001
WO WO 02/47139 A2 6/2002

OTHER PUBLICATIONS

Electronic Materials, vol. 40, No. 3, p. 96.
The Latest CMP Process and Material Technlogy Supervised by Toshiro Doi and Masaharu Kinoshita, Technical Information Society, p. 257, p. 261, p. 272.

* cited by examiner

*Primary Examiner*—David B. Thomas
(74) *Attorney, Agent, or Firm*—Nixon Peabody LLP; David S. Safran

(57) ABSTRACT

In a wafer polishing apparatus which polishes a wafer surface or in a wafer cleaner, there are provided a transfer and cleaning chamber which shuts off a wafer from the outside air and an inert gas supply device which fills an inert gas into the transfer and cleaning chamber. Thus, there are provided a polishing apparatus, a cleaner, a cleaning method and a wafer evacuation program which can prevent the oxidation and modification of a wafer surface in each step, such as the polishing step of a wafer, the transfer step after polishing, the cleaning step after polishing, the drying step after polishing, the inspection step after polishing, and the storage step after polishing.

9 Claims, 7 Drawing Sheets

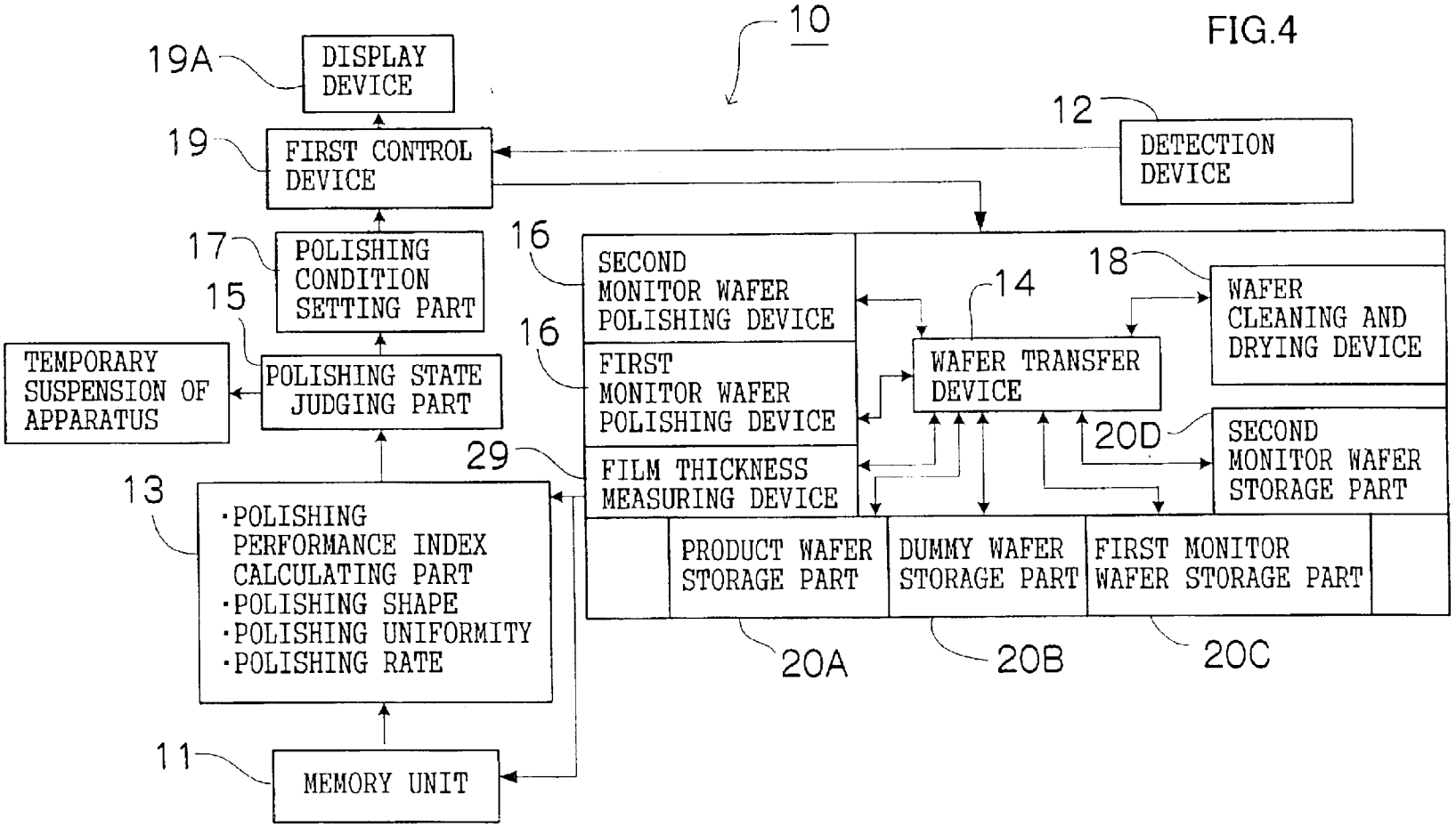
FIG.4
10
DETECTION DEVICE
12
WAFER CLEANING AND DRYING DEVICE
18
SECOND MONITOR WAFER STORAGE PART
20D
FIRST MONITOR WAFER STORAGE PART
20C
WAFER TRANSFER DEVICE
14
DUMMY WAFER STORAGE PART
20B
PRODUCT WAFER STORAGE PART
20A
SECOND MONITOR WAFER POLISHING DEVICE
16
FIRST MONITOR WAFER POLISHING DEVICE
16
FILM THICKNESS MEASURING DEVICE
29
DISPLAY DEVICE
19A
FIRST CONTROL DEVICE
19
POLISHING CONDITION SETTING PART
17
POLISHING STATE JUDGING PART
15
TEMPORARY SUSPENSION OF APPARATUS
·POLISHING PERFORMANCE INDEX CALCULATING PART
·POLISHING SHAPE
·POLISHING UNIFORMITY
·POLISHING RATE
13
MEMORY UNIT
11

POLISHING APPARATUS AND METHOD, AND WAFER EVACUATION PROGRAM

BACKGROUND OF THE INVENTION

1. Field of the Invention

The present invention relates to a polishing apparatus and a polishing method and, more particularly, to a polishing apparatus and polishing method of a wafer in an inert gas atmosphere. Furthermore, the present invention relates to a polishing apparatus, a polishing method and a wafer evacuation program and, more particularly, to a polishing apparatus, a polishing method and a wafer evacuation program which evacuates a wafer when some trouble occurs during the working of the wafer.

2. Description of the Related Art

In recent years, owing to the development of semiconductor technology, progress has been made in the miniaturization of design rule and the trend toward multi-layer interconnection. Usually, a Cu damascene structure formed on the surface of a semiconductor wafer is such that a Cu film which is an interconnect film is formed on the surface, a TaN film or a Ta film which is a barrier film is formed under the interconnect film, and an oxide film is further formed under the barrier film. For this reason, in the chemical mechanical polishing (CMP) of Cu, polishing is performed by two steps, i.e., the Cu film is first removed by polishing and the barrier film, such as a TaN film, is then removed by polishing.

A wafer to be polished is taken out of a dedicated cassette by use of a handling device such as an indexing robot, and is then transferred to the polishing step to remove the Cu film and TaN film via a film thickness measuring step. If the step of removing the Cu film is called the first step and the step of removing the TaN film is called the second step, then in the Cu removal step, which is the first step, polishing is finished when TaN appears after the removal of Cu and the working proceeds to the second step. In general, in the TaN removal step, which is the second step, slurry which enables TaN to be relatively well polished is used. Therefore, the first and second steps are not performed by use of the same polishing pad and are carried out by means of separate polishing devices. After the polishing of the second step is performed, the wafer passes through a rough cleaning step for removing the polishing slurry and polishing powder, a precision cleaning step, a rinse step and a drying step and is housed in a dedicated cassette via the film thickness measuring step again.

In the wafer transfer step after this polishing step, during the rough cleaning step, the precision cleaning step, the rinse step, the drying step and the film thickness measuring step, the wafer surface after polishing may be oxidized and modified, posing a problem. In particular, metal materials such as Cu, Al and W which are used as conductors of wiring materials have the characteristic that portions in contact with the outside air are apt to be oxidized. In recent years, because interconnect portions are made fine, the surface area is large for the sectional area. This oxidation of the surfaces of wiring materials results in a substantial decrease in the conductivity and high-frequency characteristics of interconnects, exerting a great influence on the quality of final products. For example, if the interconnect width and interconnect depth of Cu, which are at present on the order of 0.1 $\mu$m, will become finer in the future, it might be thought that the degree of oxidation of the surfaces of wiring materials will pose a big problem.

Furthermore, in a case of retention of a product due to a trouble in the apparatus or work in the wafer polishing step, the oxidation or modification of the wafer surface proceeds, yielding the irregularity that the wafer quality is made worse thereby.

In the polishing step of the wafer surface, polishing slurry which performs fine etching by chemically reacting with a wiring material which is the film to be polished, such as Cu, is used. Also is used a cleaning chemical solution which performs fine etching by chemically reacting with a wiring material which is the film to be polished, such as Cu. It is necessary to very stringently control the time for which such a polishing slurry and cleaning chemical solution react with the wafer surface. If a wafer is left immersed in such a solution for a long time, the surface of the wafer is chemically modified by the etching of copper etc., bringing about a decrease in the conductivity of interconnects and in some cases causing troubles such as a breakage of interconnects, with the result that defective goods are produced.

Examples of such a conventional CMP system are described in the following literature, etc. However, no consideration is given to the oxidation and modification of surfaces. Reference material: The Latest CMP Process and Material Technology, Supervised by Toshiro Doi and Masaharu Kinoshita, Technical Information Society, p.257, p.261, p.272, etc. Reference literature: Electronic Materials, VOL. 40, No. 3, p.96, etc.

SUMMARY OF THE INVENTION

The present invention has been made in view of such a situation and has as its object the provision of a polishing apparatus and a polishing method which can prevent the oxidation and modification of wafer surfaces in each step, such as the transfer step after polishing, the cleaning step, the drying step, the inspection step and the storage step.

Furthermore, even when a trouble occurs in the polishing apparatus, the present invention prevents the retention of a wafer in a condition exposed to the atmospheric air during the polishing step, immediately after the polishing step, in the transfer step after polishing, the cleaning step, the drying step, the inspection step, the storage step, etc., thereby making it possible to prevent the oxidation and modification of wafer surfaces.

In order to attain the above-described object, the present invention is directed to a polishing apparatus, comprising: a polishing pad on which a wafer is pressed to polish a surface of the wafer; a housing which shuts off the wafer from an outside air; and an inert gas supply device which fills an inert gas into the housing.

According to the present invention, since the housing (a transfer and cleaning chamber) which shuts off the wafer from the outside air is provided in a transfer step part, a cleaning step part and an inspection step part and an inert gas supply device which fills an inert gas into the housing is provided, it is possible to prevent the oxidation and modification of the wafer surface in each step, such as the transfer step after polishing, the cleaning step after polishing, the drying step after polishing, the inspection step after polishing, and the storage step after polishing.

Furthermore, the present invention is also directed to a polishing apparatus, comprising: a polishing pad on which a wafer is pressed to polish a surface of the wafer, a wafer storage chamber which temporarily stores the wafer to shut off the wafer from an outside air; an inert substance filling device which fills an inert substance into the wafer storage chamber, the inert substance including at least one of an inert gas and an inert liquid, and a wafer carrying device which carries the wafer into the wafer storage chamber.

According to the present invention, since there are provided the wafer storage chamber, which temporarily stores the wafer and shuts off the wafer from the outside air, the inert substance filling device, which fills the inert substance, such as an inert gas and an inert liquid, into the wafer storage chamber, and the wafer carrying device, which carries the wafer into the wafer storage chamber, it becomes possible to prevent the oxidation and modification of the wafer surface in the polishing step, immediately after polishing, in the transfer step after polishing, the cleaning step after polishing, the drying step after polishing, the inspection step after polishing, the storage step after polishing, etc.

Preferably, the polishing apparatus further comprises: a detection device which detects a trouble occurring in the polishing apparatus, wherein the wafer carrying device carries the wafer into the wafer storage chamber when the detection device detects the trouble occurring in the polishing apparatus.

According to the present invention, the polishing apparatus is provided with the detection device which detects a trouble occurring in the polishing apparatus, and the wafer carrying device carries a wafer into the wafer storage chamber when the detection devices detects the trouble occurring in the polishing apparatus. Therefore, even when a trouble occurs in the polishing apparatus, it becomes possible to prevent the retention of the wafer in a condition exposed to the atmospheric air during the polishing step, immediately after the polishing step, in the transfer step after polishing, the cleaning step, the drying step, the inspection step, the storage step, etc., thereby making it possible to prevent the oxidation and modification of wafer surfaces.

Preferably, the inert liquid is one of ultrapure water containing dissolved oxygen of not less than 0.1 ppm and not more than 1 ppm, and ultrapure water having a resistivity of not less than 16 MΩ and not more than 30 MΩ.

According to the present invention, since ultrapure water containing dissolved oxygen of not less than 0.1 ppm and not more than 1 ppm or ultrapure water having a resistivity of not less than 16 MΩ and not more than 30 MΩ is used as the inert liquid to be used in the polishing apparatus, it becomes possible to prevent the oxidation and modification of the wafer surface at low cost.

In order to attain the above-described object, the present invention is also directed to a polishing apparatus, comprising: a polishing pad on which a wafer is pressed to polish a surface of the wafer; a detection device which detects a trouble occurring in the polishing apparatus; a wafer storage chamber which temporarily stores the wafer to shut off the wafer from an outside air; an inert substance filling device which fills an inert substance into the wafer storage chamber, the inert substance including at least one of an inert gas and an inert liquid; a wafer carrying device which carries the wafer into the wafer storage chamber; and a control device which outputs an instruction to the wafer carrying device to carry the wafer into the wafer storage chamber when the detection device detects the trouble occurring in the polishing apparatus.

According to the present invention, there are provided the detection device which detects a trouble occurring in the polishing apparatus, the wafer storage chamber, which temporarily stores the wafer and shuts off the wafer from the outside air, the inert substance filling device, which fills the inert substance, such as an inert gas and an inert liquid, into the wafer storage chamber, the wafer carrying device, which carries the wafer into the wafer storage chamber, and the control device, which outputs an instruction to the wafer carrying device to carry the wafer into the wafer storage chamber when the detection device detects the trouble occurring in the polishing apparatus. Therefore, even when a trouble occurs in the polishing apparatus, it becomes possible to prevent the retention of the wafer in a condition exposed to the atmospheric air during the polishing step, immediately after the polishing step, in the transfer step after polishing, the cleaning step after polishing, the drying step after polishing, the inspection step after polishing, the storage step after polishing, etc., thereby making it possible to prevent the oxidation and modification of wafer surfaces.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 4 is a block diagram of a signal processing system of a polishing apparatus according to the first embodiment of the present invention;

DETAILED DESCRIPTION OF THE PREFERRED EMBODIMENTS

Preferred embodiments of a polishing apparatus, a polishing method and a wafer evacuation program according to the present invention will be described in detail with reference to the accompanying drawings.

Figure 1:
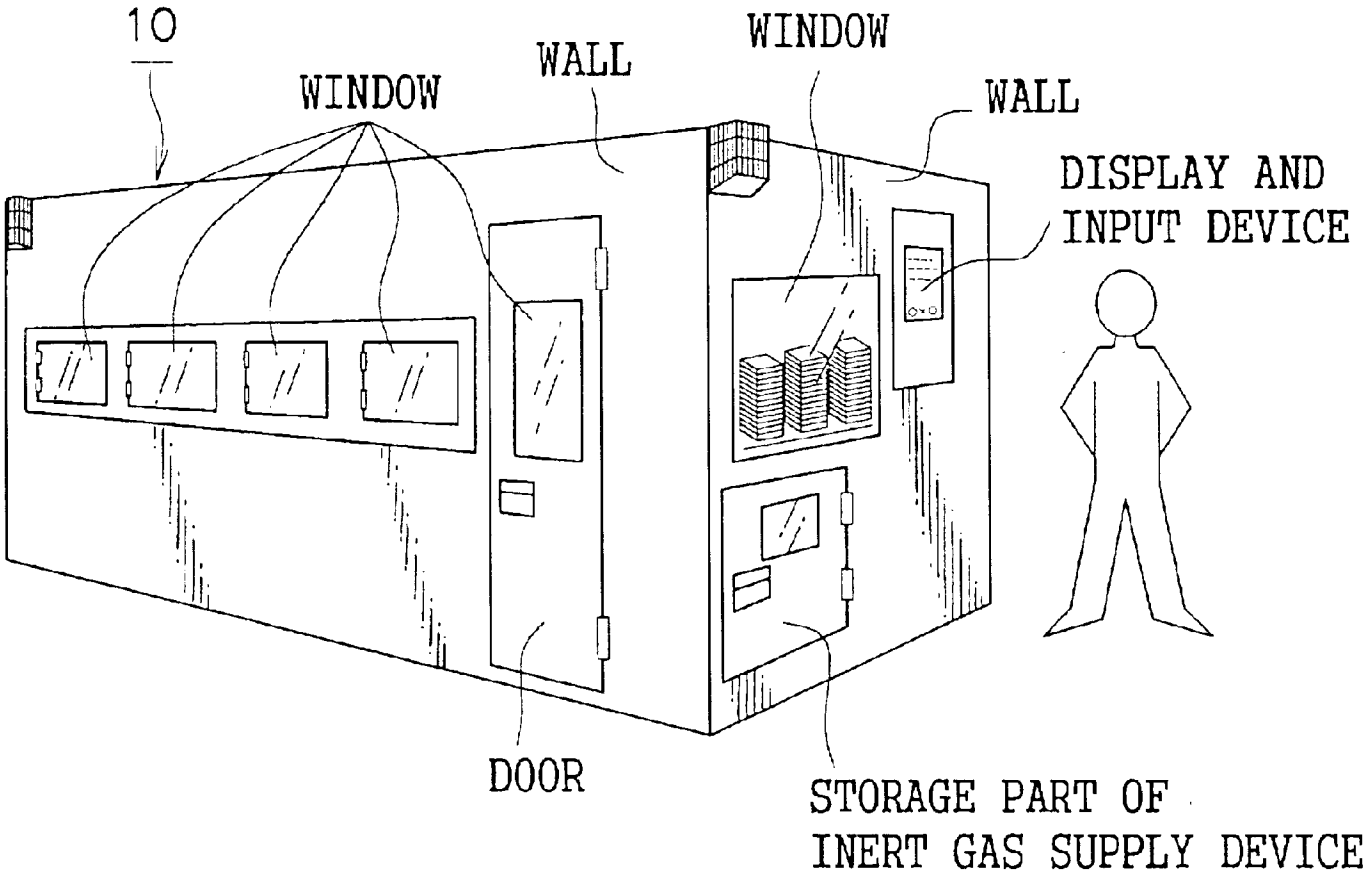
FIG. 1 is an appearance perspective view of a polishing apparatus according to the present invention.

FIG. 1 shows an appearance perspective view of a polishing apparatus according to the present invention. As shown in FIG. 1, the transfer step portion, the cleaning step portion, etc. within a wafer polishing apparatus 10 are enclosed with walls, windows and a door. During the transfer and cleaning of a wafer W, the exterior and the interior of the wafer polishing apparatus 10 are kept in a shut-off condition, and for example, the interior of the wafer polishing apparatus 10 is filled with an inert gas. On the side surface of the wafer polishing apparatus 10 is provided a door of a storage part of an inert gas supply device so that an operator can open the door for work during the change of inert gas cylinders and the maintenance of the inert gas supply device.

Figure 2:
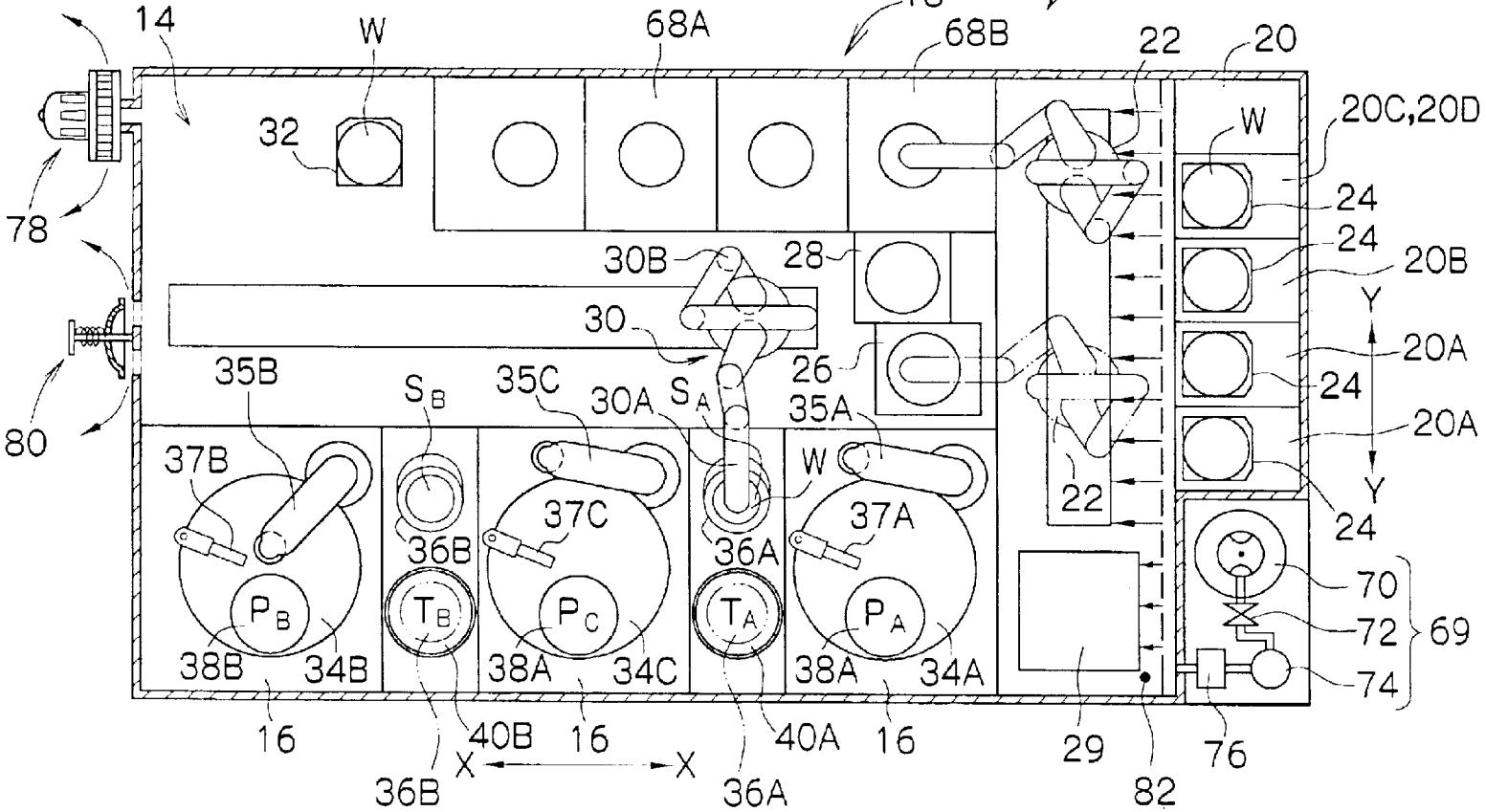
FIG. 2 is a general plan sectional view of a polishing apparatus according to the first embodiment of the present invention.

FIG. 2 is a plan sectional view of a polishing apparatus in the first embodiment of the present invention. As shown in FIG. 2, a wafer polishing apparatus 10 comprises a wafer storage part 20, a transfer device 14, polishing devices 16, 16, 16, a cleaning and drying device 18, a film thickness measuring device 29, and an inert gas supply device 69.

The wafer storage part 20 comprises product wafer storage parts 20A, a dummy wafer storage part 20B, a first monitor wafer storage part 20C and a second monitor wafer storage part 20D, and a wafer W housed in a cassette 24 is stored in each of the store parts. Two product wafer storage parts 20A are provided side by side. The lower shelf of the cassette 24 is used for the first monitor wafer storage part 20C, and the upper shelf of the same cassette 24 is used for the second monitor wafer storage part 20D.

The transfer device 14 comprises an indexing robot 22, a transfer robot 30 and transfer units 36A, 36B. The indexing robot 22 has two arms which are freely turnable and freely bendable and is provided so as to be freely movable along the direction indicated by arrows Y in FIG. 2. The indexing robot 22 takes a wafer W to be polished from the cassette 24 placed in each wafer storage part and transfers the wafer W to the film thickness measuring device 29 and delivering ports 26, 28. Moreover, the indexing robot 22 takes a wafer W for which cleaning has been finished from the cleaning and drying device 18 and houses the wafer W in the cassette 24. The transfer robot 30 has a loading arm 30A and an unloading arm 30B which are freely turnable and freely bendable and is provided so as to be freely movable along the direction indicated by arrows X in FIG. 2. The loading arm 30A, which is used to transfer a wafer W before polishing, receives the wafer W before polishing by a pad (not shown) provided at the leading end thereof from the delivering ports 26, 28 and transfers the wafer W to the transfer units 36A, 36B. On the other hand, the unloading arm 30B, which is used to transfer a wafer W after polishing, receives the wafer W after polishing by a pad (not shown) provided at the leading end thereof from the transfer units 36A and 36B and transfers the wafer W to the cleaning and drying device 18 or an unloading cassette 32. Both the transfer units 36A and 36B are provided so as to be freely movable along the direction indicated by the arrows Y in FIG. 2 and move respectively between receiving positions $S_A$, $S_B$ and delivering positions $T_A$, $T_B$. The transfer units 36A, 36B receive a wafer W to be polished from the loading arm 30A of the transfer robot 30 in the receiving position $S_A$, $S_B$, move to the delivering positions $T_A$, $T_B$ and deliver the wafer W to polishing heads 38A, 38B. Also, the transfer units 36A, 36B receive a wafer W after polishing in the delivering positions $T_A$, $T_B$, move to the receiving positions $S_A$, $S_B$ and deliver the wafer W to the unloading arm 30B of the transfer robot 30. Each of the transfer units 36A, 36B has two separate receiving beds. These two receiving beds are used properly for wafers W before polishing and wafers W after polishing. Adjacent to the cleaning and drying device 18 is provided the unloading cassette 32, which is used to temporarily house a wafer W after polishing. For example, during the stop of operation of the cleaning and drying device 18, a wafer W after polishing is transferred to the transfer robot 30 and is temporarily housed.

The polishing devices 16, 16, 16, which are used to polish wafers W, are provided with polishing platens 34A, 34B, 34C, the polishing heads 38A, 38B, slurry supply nozzles 37A, 37B, 37C and carrier cleaning units 40A, 40B. The polishing platens 34A, 34B, 34C are formed in disk shape and the three polishing platens are arranged side by side. To the top surfaces of the polishing platens 34A, 34B, 34C are applied polishing pads (not shown), and slurry is supplied from the slurry supply nozzles 37A, 37B, 37C to these polishing pads. Furthermore, each of the polishing platens 34A, 34B, 34C is driven by a motor (not shown) and rotates. A wafer W is polished by being pressed against the polishing platens 34A, 34B, 34C which rotate.

The left-hand and right-hand polishing platens 34A, 34B out of the three polishing platens 34A, 34B, 34C are used for the polishing of a first film to be polished and the center polishing platen 34C is used for the polishing of a second film to be polished. In the polishing of both, the kind of slurry to be supplied, the rotational speed of the polishing heads, the rotation of the polishing platens, the pressing force of the polishing heads, the material for the polishing pads, etc., are changed. In the vicinity of the polishing platens 34A, 34B, 34C there are provided dressing devices 35A, 35B, 35C, respectively. The dressing devices 35A, 35B, 35C are each provided with a freely turnable arm and perform the dressing of the polishing pads by the dresser which provided at the leading end of the arm on the polishing platens 34A, 34B, 34C. The number of the polishing heads 38A, 38B is two and each of the polishing heads 38A, 38B is provided so as to be freely movable along the direction indicated by the arrows X in FIG. 2.

With a held wafer W pressed against the polishing pad on the polishing platen 34A, the polishing head 38A polishes the wafer W by supplying slurry onto the polishing pad while rotating both the polishing platen 34A and the polishing head 38A. The polishing head 38B on the other side is also similarly configured.

As shown in FIG. 2, the two carrier cleaning units 40A, 40B are arranged between the polishing platens 34A, 34B, 34C. These carrier cleaning units 40A, 40B are disposed respectively in the prescribed delivering positions $T_A$, $T_B$ of the transfer units 36A, 36B. The carrier cleaning units 40A, 40B clean the carriers of the polishing heads 38A, 38B after the completion of polishing.

The cleaning and drying device 18 cleans a wafer W for which polishing has been finished. The cleaning and drying device 18 is provided with a cleaner 68A and a drier 68B. The cleaner 68A has three cleaning tanks, which are arranged in the order of rough cleaning, precision cleaning, and rinse. In the rough cleaning part, an alkaline solution is applied to a wafer W and the cleaning of the surface of the wafer W is performed by use of a double side brush. In the precision cleaning part, an acid chemical solution is applied to the wafer W and the cleaning of the surface of the wafer W is performed by use of a double side brush. Furthermore, in the rinse part, precision cleaning by use of a pen brush is performed by supplying ultrasonic water. A wafer W which has been polished by the polishing devices 16, 16, 16 is transferred by the transfer robot 30 to the cleaning and drying device 18, subjected to rough cleaning, precision cleaning and rinse by the cleaner 68A of this cleaning and drying device 18, and then dried by the drier 68B. The dried wafer W is taken by the indexing robot 22 out of the drier 68B and housed in a prescribed position of the cassette 24 in the wafer storage part 20 after film thickness measurement is performed as required by use of the film thickness measuring device 29.

The film thickness measuring device 29 has a centering mechanism of a wafer W and a film thickness measuring machine. As the film thickness measuring machine, a spectra type film thickness measuring machine, for example, is used when the film to be polished is an oxide film, and a 4-probe resistivity measuring device, for example, is used when the film to be polished is a metal film.

The inert gas supply device 69 of the polishing apparatus according to the present invention is provided with an inert gas cylinder 70 which is filled with a rare gas, such as helium, argon and neon, or an inert gas of low reactivity, such as nitrogen and carbon dioxide, a valve 72 which controls the supply and stop of an inert gas, a gasifier 74 which gasifies an inert gas stored as a liquid, and a governor 76 which regulates the supply pressure of an inert gas to the same pressure as the atmospheric pressure or a pressure a little higher than the atmospheric pressure.

During the transfer step or cleaning step of a wafer W, etc., an inert gas or its liquid is caused to flow from the inert gas cylinder 70 into the gasifier 74 by opening the valve 72, and the pressure of the inert gas obtained by gasification by the gasifier 74 is set to a prescribed pressure by the governor 76. After that, the inert gas is caused to flow into a transfer and cleaning chamber 82 (a housing which includes a transfer chamber and a cleaning chamber to shut off a wafer W from the outside air) via a gallery. In this manner, since the pressure of the interior of the transfer and cleaning chamber 82 is set to a pressure as a pressure substantially equal to the atmospheric pressure or a little higher than the outside pressure, it is possible to fill the interior of the transfer and cleaning chamber 82 with the inert gas without the inflow of the air containing oxygen from the outside. In the transfer and cleaning chamber 82 shown in FIG. 2, it is possible to shut off the wafer W present in the transfer step, the cleaning step, the inspection step and the storage step from the outside air.

In the transfer and cleaning chamber 82 is provided a damper 80 which provides an exhaust opening of the gas in the transfer and cleaning chamber 82. When the pressure in the transfer and cleaning chamber 82 becomes higher than the outside atmospheric pressure, the damper 80 can enable the gas in a flow rate corresponding to the pressure difference to flow to the outside of the transfer and cleaning chamber 82. Alternatively, a blower 78 may be provided additionally to or instead of the damper 80 so that the gas in the transfer and cleaning chamber 82 is exhausted to the outside.

In the above description, an example in which an inert gas is caused to flow at a given pressure was given by means of governor 76. However, the present invention is not limited to this example and it is possible to achieve the object of the present invention by such a configuration that the pressure in the transfer and cleaning chamber is measured by a pressure gauge and the flow rate and exhaust pressure of the inert gas are regulated on the basis of the measured pressure.

The transfer and cleaning chamber 82 is provided with openings, such as a door to carry a wafer W in and out and a door for the maintenance of the polishing heads 38A, etc., and dressing devices 35A etc. Packing is provided in each of the doors for the openings to form a structure which ensures rough shutting off from the outside atmosphere.

It is mostly in a wafer W after polishing that the oxidation and modification of the wafer surface pose a problem. Therefore, the housing which shuts off a wafer W from the outside air may be independently provided in the transfer step part after polishing, the rough cleaning step part, the precision cleaning step part, the rinse step part, the inspection step part and the polished wafer storage part. Also, it is possible to achieve the object of the present invention by installing a wafer cleaning device provided with the transfer device 14, the cleaner 68A, the drier 68B, the film thickness measuring device 29 (the inspection step), etc., in a housing different from the polishing device 16 and by carrying out the transfer step of a wafer W, the cleaning step, the rinse step, the drying step, the inspection step, the storage step, etc., with the interior of the housing of this cleaning device filled with an inert gas.

Figure 3:
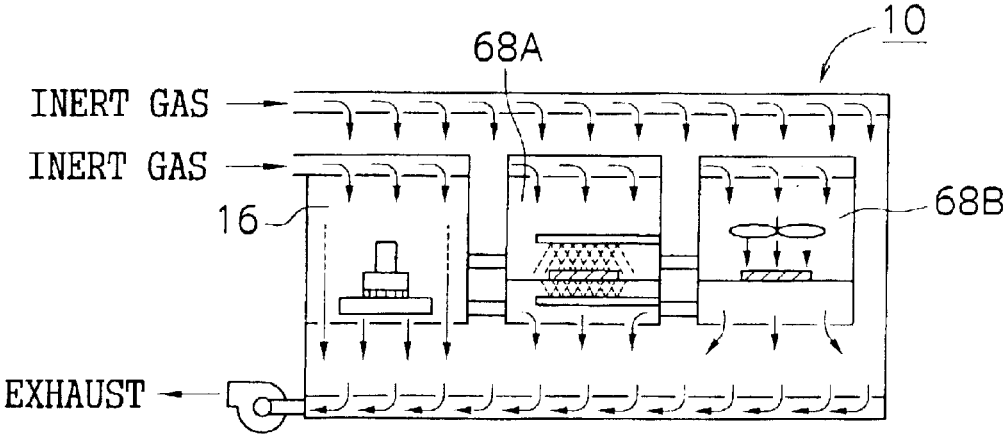
FIG. 3 is a view showing a housing of a polishing apparatus according to another embodiment of the present invention.

FIG. 3 shows a housing of a polishing apparatus according to another embodiment of the present invention. FIG. 3 is a sectional view when module housings provided in the polishing device 16, cleaner 68A and drier 68B of the wafer polishing apparatus 10 are viewed from the side of this polishing apparatus 10. An inert gas flows out from the upper part of the wafer polishing apparatus 10 and from the upper parts of the module housings of the polishing device 16, cleaner 68A, drier 68B, etc., passes through the interior of the module housings in downflow, and is then exhausted from the lower parts of the module housings.

Although the example shown in FIG. 2 is an embodiment in which almost the whole of the wafer polishing apparatus 10 is enclosed in one housing, as shown in FIG. 3, it is possible to achieve the object of the present invention by installing module housings which shut off a wafer W from the outside air separately in the cleaning step part and the drying step part and, as required, in the rinse step part or the inspection step part and by filling the module housings with an inert gas.

FIG. 4 is a block diagram of a signal processing system of the polishing apparatus in the first embodiment of the present invention. As shown in FIG. 4, the signal processing system of the wafer polishing apparatus 10 is provided with various types of control block, such as a memory unit 11, a detection device 12, a polishing performance index calculating part 13, a polishing state judging part 15, a polishing condition setting part 17 and a first control device 19, etc. The memory unit 11 stores film thickness data of a wafer W measured by the film thickness measuring device 29, the detection device 12 detects various troubles occurring in the wafer polishing apparatus 10, and the polishing performance index calculating part 13 can calculate polishing performance indices, such as polishing uniformity, polishing rate and polishing shape, etc., from the above-described film thickness data, the working time required by polishing, etc. The polishing state judging part 15 has a device which judges whether the polishing of a product wafer W or the monitor polishing of a monitor wafer is to be performed from the polishing performance indices, such as polishing uniformity, polishing rate and polishing shape, etc., which are found by the polishing performance index calculating part 13. In the polishing condition setting part 17, polishing conditions and polishing feature control parameters are set according to polishing performance indices such as polishing uniformity, polishing rate and polishing shape, etc., which are found by the polishing performance index calculating part 13. The first control device 19 is a controller which controls the operation of the apparatus in response to judgment signals in each of the above-described parts and set signals, and the display device 19A is a display which displays polishing performance indices, polishing conditions, etc.

The wafer polishing apparatus 10 configured as described above processes a wafer W as follows.

First prior to polishing, an inert gas is filled into the interior of the transfer and cleaning chamber 82. In the transfer and cleaning chamber 82, the proportion of the inert gas increases gradually and the volume of oxygen contained in the transfer and cleaning chamber 82 decreases relatively. By filling the interior of the transfer and cleaning chamber 82 with the inert gas, it becomes possible to prevent the oxidation and modification of the wafer surface in each step, such as the transfer step after CMP, the cleaning step, the drying step and the inspection step.

When the interior of the transfer and cleaning chamber 82 is filled with the inert gas, the CMP of a wafer W is started. The wafer W housed in the cassette 24 is taken out by the indexing robot 22 and transferred to the film thickness measuring device 29. The film thickness measuring device 29 then performs centering and, as required, film thickness measurement. The centered wafer W is taken out by the indexing robot 22 and placed on the delivering port 26 or 28. Next, this wafer W is taken out by the loading arm 30A of the transfer robot 30 from the delivering port 26 or 28 and transferred to the transfer unit 36A. In the transfer unit 36A, the receiving bed is on standby beforehand in the prescribed receiving position $S_A$ and the wafer W is delivered from the loading arm 30A to the receiving bed for loading positioned in this receiving position $S_A$. The receiving bed for loading to which the wafer W has been received advances and moves to the prescribed delivering position $T_A$. Above this delivering position $T_A$, the polishing head 38A is on standby beforehand, and the wafer W is delivered to this polishing head 38A from the receiving bed for loading.

The polishing head 38A which has received the wafer W holds this wafer W by suction with the carrier and moves to a prescribed polishing position $P_A$. In this position, the polishing head 38A cancels the suction, places the wafer W on a polishing pad and the wafer W is polished. Polishing is performed in such a manner that with the wafer W pressed against the polishing pad by use of the carrier, both the polishing platen 34A and the polishing head 38A are rotated and the first film to be polished is polished by supplying a slurry onto the rotating polishing pad from the slurry supply nozzle 37A.

The wafer W for which polishing has been finished is again held by suction with the carrier and recovered from the polishing platen 34A. When the second film to be polished is polished after that, the polishing head 38A moves to a polishing position $P_C$ on the center polishing platen 34C. The polishing head 38A then performs the polishing of the second film to be polished on this center polishing platen 34C by changing polishing characteristics. On the other hand, when polishing is finished with the first film to be polished alone, the polishing head 38A moves to the prescribed delivering position $T_A$. The polishing head 38A then delivers the wafer W to the receiving bed for unloading of the transfer unit 36A which has seated beforehand in the delivering position $T_A$.

Also in a case where the polishing of the second film to be polished has been performed on the center polishing platen 34C, after the completion of the polishing, the polishing head 38A moves from the polishing position $P_C$ to the delivering position $T_A$ and delivers the wafer W to the receiving bed for unloading.

The receiving bed for unloading of the transfer unit 36A to which the wafer W after polishing has been delivered in the delivering position $T_A$ moves backward to the prescribed receiving position $S_A$. The wafer W is then taken out by the unloading arm 30B of the transfer robot 30 from the receiving bed for unloading which has seated in this receiving position $S_A$ and transferred to the cleaning and drying device 18.

The wafer W which has been transferred to the cleaning and drying device 18 is subjected to rough cleaning, precision cleaning and rinse by the cleaner 68A and dried by the drier 68B. Then, the wafer W which has been dried by the drier 68B is taken out by the indexing robot 22 of the transfer device 14 from the drier 68B, transferred to the film thickness measuring device 29 as required, and again housed by the indexing robot 22 in the prescribed position of the cassette 24 which has been set in the wafer storage part 20 after the measurement of the film thickness. The polishing of one wafer W is completed in an inert gas atmosphere after the above-described series of steps.

Figure 5:
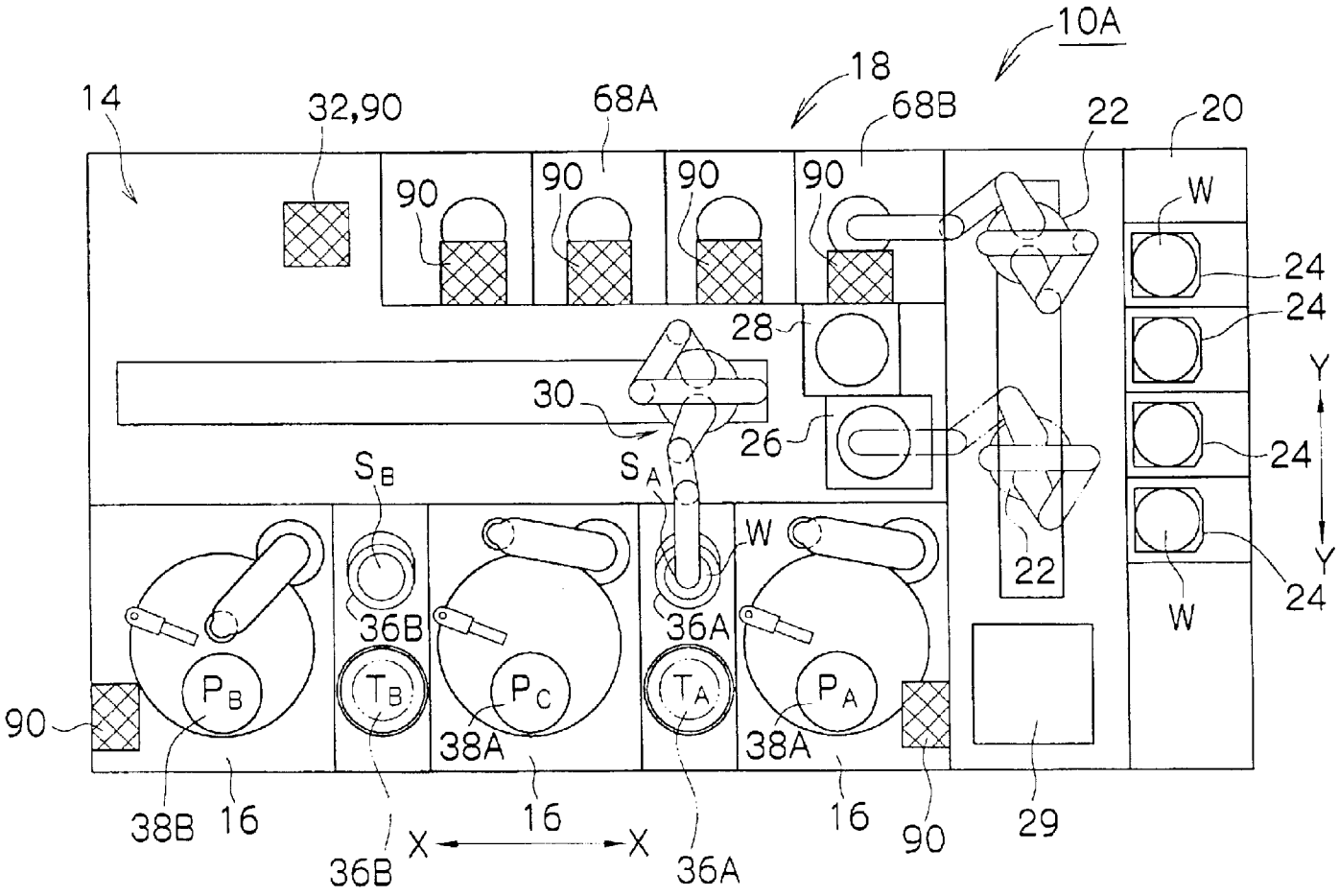
FIG. 5 is a plan sectional view of a polishing apparatus according to the second embodiment of the present invention.

FIG. 5 is a plan sectional view of a polishing apparatus according to the second embodiment of the present invention. As shown in FIG. 5, a wafer polishing apparatus 10A is provided with a wafer polishing device 16, an unloading cassette 32 (which may have the function of a wafer storage chamber 90, which will be described later), each cleaning module of a cleaner 68A and a drier 68B, and a wafer storage chamber 90 is provided in the interior or vicinity of each of these parts. On the basis of instructions from a first control device 19 or a second control device 21, which will be described later, it is possible to fill this wafer storage chamber 90 with a liquid of low reactivity such as pure water or a gas of low reactivity such as an inert gas.

Figure 6:
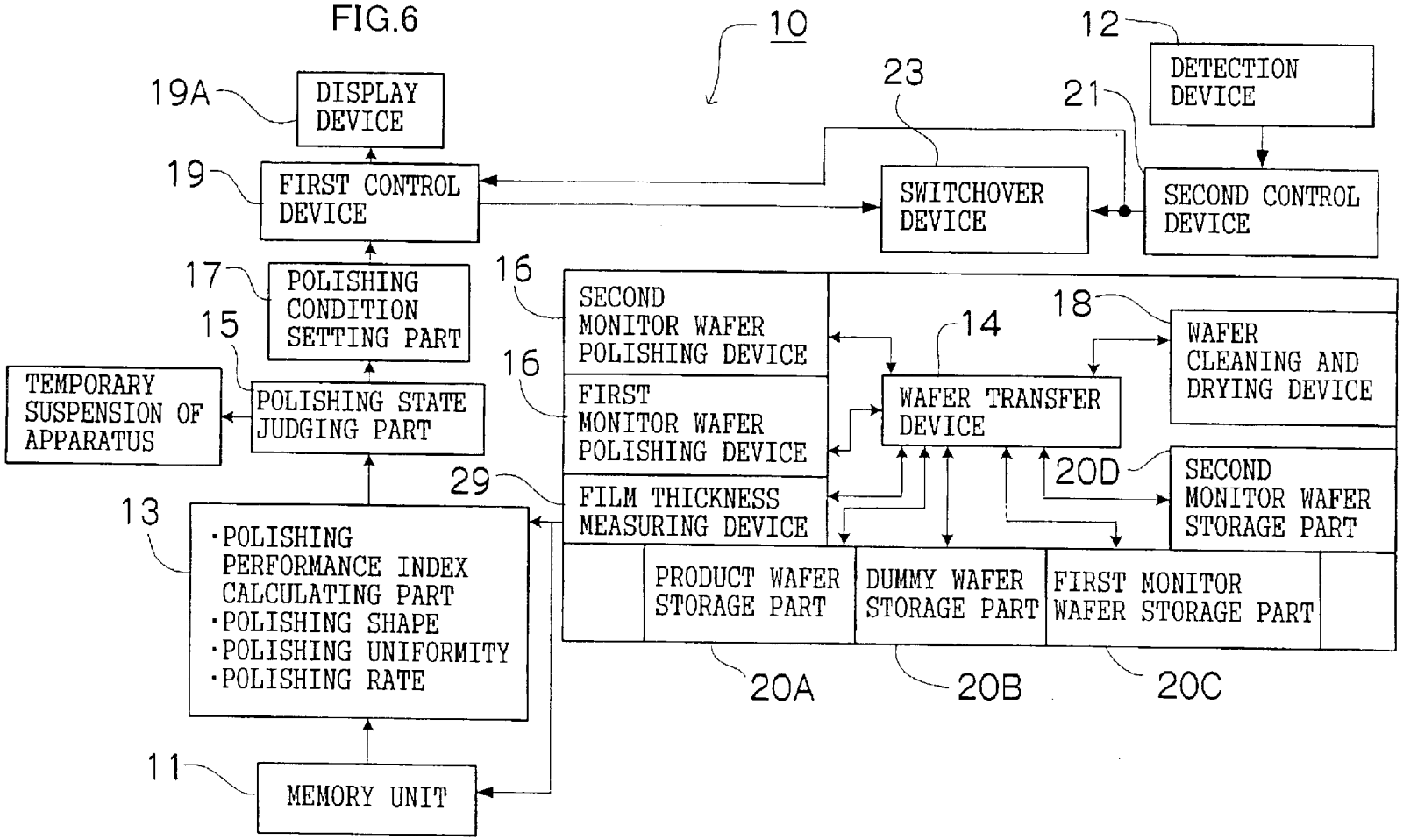
FIG. 6 is a block diagram of a signal processing system of a polishing apparatus according to the second embodiment of the present invention.

FIG. 6 shows a block diagram of a signal processing system of the polishing apparatus according to the second embodiment of the present invention. The block diagram in FIG. 6 shows an embodiment in which the independent second control device 21 is added to the block diagram shown in FIG. 4. Therefore, descriptions of blocks having the same functions as in FIG. 4 are omitted.

As with the embodiment shown in FIG. 4, the detection device 12 can detect various troubles in the polishing apparatus 10A and troubles in the first control device 19. Information on the detected troubles is transmitted from the detection device 12 to the second control device 21. When it is judged that the information on a trouble detected by the detection device 12 is such that ordinary polishing cannot be continued any more due to the trouble, which is so serious that it cannot be avoided by the first control device 19, the second control device 21 outputs switchover information to the first control device 19 and a switchover device 23 to the effect that the control of the polishing apparatus 10A is switched over from the first control device 19 to the second control device 21. Concrete examples of troubles occurring in the polishing apparatus 10A will be described later.

The first control device 19 which has received the above-described switchover information interrupts the control of the wafer polishing apparatus 10A. Furthermore, the changeover device which has received the above-described switchover information performs processing to change over the control of the transfer device 14, the polishing device 16, the cleaning and drying device 18, the product wafer storage part 20A, etc. from the first control device 19 previously used to the second control device 21. This switchover processing of control enables the second control device 21 to perform thereafter the control of the transfer device 14, the polishing device 16, the cleaning and drying device 18, the product wafer storage part 20A, etc.

When the control of the whole polishing apparatus 10A is changed from the first control device 19 to the second control device 21 on the basis of information that the trouble has occurred in the polishing apparatus 10A, the second control device 21 carries out a "wafer evacuation program" to carry a wafer W which is being polished by the polishing device 16 or a wafer W for which polishing has been finished into the wafer storage chamber 90 by use of the polishing head 38A, etc. Alternatively, instead of carrying the wafer W into the wafer storage chamber 90, the wafer W may be carried into the cassette 24 through the transfer unit 36A, etc., the transfer robot 30, the indexing robot 22, etc.

On the basis of instructions from the second control device 21 or when the detection device 12 detects that the trouble has occurred in the wafer polishing apparatus 10A, the transfer robot 30, the polishing head 38, the transfer units 36A, 36B and the wafer carrying device including the indexing robot 22 can evacuate and house the wafer W during or after polishing, during or after cleaning or during movement.

When the detection device 12 detects that the trouble has occurred in the wafer polishing apparatus 10A, on the basis of this trouble information the second control device 21 can output instructions to carry the wafer W into the wafer storage chamber 90 to the transfer robot 30, the polishing head 38, the transfer units 36A, 36B and the wafer carrying device including the indexing robot 22 in order to evacuate the wafer during or after polishing, during or after cleaning or during movement.

Also, it is possible to achieve the object of the present invention by ensuring that the polishing device 16, the cleaning and drying device 18, the wafer storage parts 20A, 20B, 20C, the transfer robot 30, the polishing heads 38A, 38B, the transfer units 36A, 36B and the wafer carrying device including the indexing robot 22 detect troubles and errors in their respective modules and output the information directly to the first control device 19 or the second control device 21 instead of directly detecting various troubles in the wafer polishing apparatus 10A by the detection device 12.

Cases where a wafer W after polishing is to be evacuated into the wafer storage chamber 90 refer to cases where a trouble occurs in the wafer polishing apparatus 10A and the detection device 12 shown in FIG. 4 or FIG. 6 detects during or after the polishing of the wafer W that a defect has occurred in the wafer W in terms of accuracy and quality, that a malfunction has occurred in the functions etc., of the polishing pad, that a malfunction has occurred in the polishing platen 34A etc., that a malfunction has occurred in the dressing device 35A etc., that a malfunction has occurred in the transfer unit, that a defect has occurred in the slurry and clean water to be supplied, that a malfunction has occurred in the transfer robot 30, that a malfunction has occurred in the indexing robot 22, that problems have arisen in other steps, and the like.

Cases where a wafer W during cleaning is to be evacuated into the wafer storage chamber 90 refer to cases where the detection device 12 detects during the cleaning of the wafer W that a defect has occurred in the wafer W in terms of quality, that a malfunction has occurred during cleaning in the cleaning brush itself or the drive of the cleaning brush, that a problem such as shortage and clogging has occurred in the cleaning liquid or cleaning water to be supplied, that a malfunction has occurred in the transfer robot 30, that a malfunction has occurred in the indexing robot 22, that problems have arisen in other steps, and the like.

Cases where a wafer W during movement is to be evacuated into the wafer storage chamber 90 refer to cases where the detection device 12 detects during the movement of the wafer W that a problem, such as a crack and a drop, has arisen in the wafer W, that a malfunction has occurred in the transfer apparatus, that a malfunction has occurred in the transfer robot 30, that a malfunction has occurred in the indexing robot 22, that problems have arisen in other steps, and the like.

The above example was described by referring to the embodiment in which in the signal processing block diagram shown in FIG 6, the detection device 12 detects troubles in the polishing apparatus 10A. However, the present invention is not limited to the embodiment shown in FIG. 6 and it is possible to achieve the object of the present invention by use of the wafer polishing apparatus 10 in which the signal processing block diagram shown in FIG. 4 is used. In this case, the second control device 21 does not perform the control of the wafer polishing apparatus 10A in place of the first control device 19. When a trouble has to occurred, a "wafer evacuation program" in the case of occurrence of the trouble is started in place of the ordinary polishing program in the first control device 19, instructions to evacuate the wafer W during or after polishing, during or after cleaning or during movement may be outputted to the wafer storage chamber 90 or the cassette 24.

Figure 7:
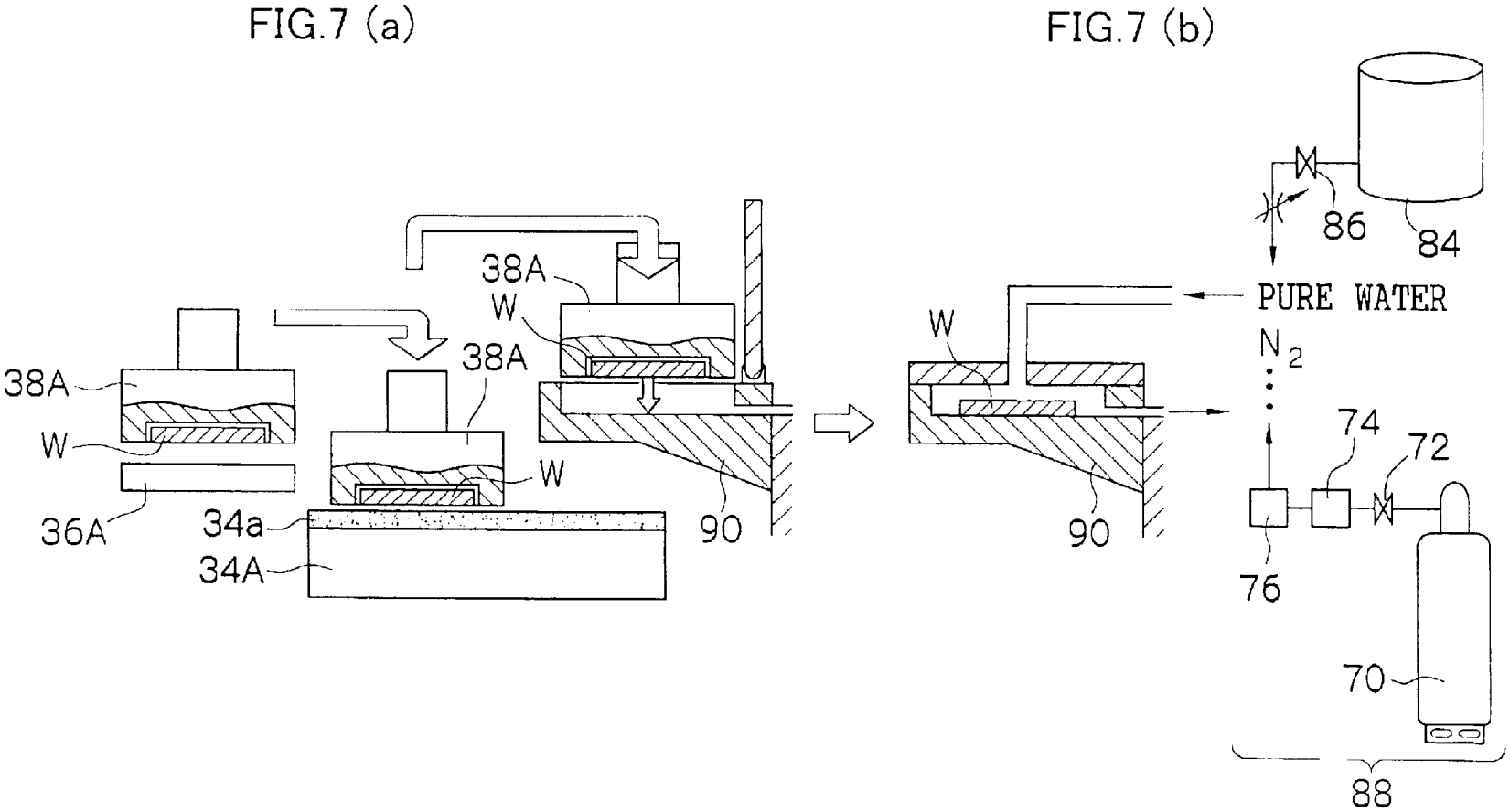
FIGS. 7(*a*) and 7(*b*) are views showing the flow of a wafer when a problem is detected after polishing.

FIGS. 7(*a*) and 7(*b*) shows the flow of a wafer W when some problem is detected in the wafer polishing apparatus 10A after polishing. As shown in FIG. 7(*a*), when a wafer W is to be polished, first, the wafer W present on the transfer unit 36A is held by suction with the carrier provided in the polishing head 38A, and moved onto the polishing platen 34A and a polishing pad 34*a* provided in the wafer polishing device 16. Next, in this position, the suction is canceled, the wafer W is placed on the polishing pad 34*a* and polished. Polishing is performed in such a manner that with the wafer W pressed against the polishing pad 34*a* at a prescribed pressing force by use of the carrier provided in the polishing head 38A, both the polishing platen 34A and the polishing head 38A are rotated and the first film to be polished and the second film to be polished are polished by supplying a slurry onto the rotating polishing pad 34*a* from the slurry supply nozzle 37A.

In ordinary polishing, a wafer W after the completion of polishing is again held by suction with the carrier provided in the polishing head 38A, recovered from the polishing platen 34A and then transferred onto the polishing platen 34C which polishes the second film to be polished or the transfer unit 36A, for example. However, in a case where some malfunction occurs in the wafer polishing apparatus 10A during or after polishing and it becomes impossible to continue the cleaning or inspection of the wafer W thereafter, the wafer W is held by suction with the carrier provided in the polishing head 38A, recovered from the polishing platen 34A and stored in the wafer storage chamber 90.

Since as shown in FIG. 7(*b*) the interior of the wafer storage chamber 90 is filled with a liquid of low reactivity or an inert gas, such as pure water or nitrogen gas, or a gas at a humidity of not less than 90% due to the working of an inert substance filling device 88, it is possible to prevent the oxidation or modification of the surface of the wafer W during the occurrence of a trouble in the wafer polishing apparatus 10A by evacuating the wafer W after polishing into the wafer storage chamber 90. Since slurry adheres to a wafer W during polishing or immediately after the completion of polishing, the progress of chemical polishing by the slurry may be prevented by causing pure water to flow through the interior of the wafer storage chamber 90. By using ultrapure water which does not contain dissimilar metals etc., and whose dissolved oxygen concentration is not more than 1 ppm or ultrapure water having a resistivity of not less than 16 MΩ as the liquid to be filled into the wafer storage chamber 90, it is possible to obtain the effect of preventing the oxidation and modification of the wafer surface. Since ultrapure water whose dissolved oxygen concentration is exceedingly low and ultrapure water having an extremely high resistivity value are very expensive, ultrapure water having a dissolved oxygen concentration of not less than 0.1 ppm and not more than 1 ppm or ultrapure water having a resistivity of not less than 16 MΩ and not more than 30 MΩ may be used.

When an inert liquid is filled into the wafer storage chamber 90 by use of the inert substance filling device 88, the inert liquid is supplied from a tank 84 where the inert liquid is stored, to the wafer storage chamber 90 via a valve 86.

When an inert gas is filled into the wafer storage chamber 90 by use of the inert substance filling device 88, the inert gas is supplied from the inert gas cylinder 70 where the inert gas is stored, to the wafer storage chamber 90 via the valve 72, the gasifier 74, the governor 76, etc.

The above example was described by referring to the embodiment in which a wafer W is stored in the wafer storage chamber 90 provided within the wafer polishing device 16 (a polishing module). However, when a wafer W is being transferred by the transfer robot 30 (the loading/unloading robot) or when a wafer W is present within the range of handling by the transfer robot 30, the first control device 19 or the second control device 21 may perform control so as to store the wafer W in the wafer storage chamber 90 (the wafer storage chamber for the robot) present in the transfer device 14.

Similarly, in a case where during or after the cleaning of a wafer W in each cleaning module of the cleaner 68A, the detection device 12 detects that some malfunction has occurred in the wafer polishing apparatus 10A and it has become impossible to continue thereafter the cleaning, drying, transfer or inspection of the wafer W, the first control device 19 or the second control device 21 may store the wafer W in the wafer storage chamber 90 provided within each cleaning module.

In a case where during or after the drying of a wafer W by the drier 68B (a wafer drying module), the detection device 12 detects that some malfunction has occurred in the wafer polishing apparatus 10A and judges that it has become impossible to continue thereafter the transfer, drying or inspection of the wafer W, the first control device 19 or the second control device 21 may store the wafer W in the wafer storage chamber 90 provided within each cleaning module.

In a case where the transfer unit (a wafer transfer cup) 36A or 36B is provided with a cover capable of opening and closing like the wafer storage chamber 90, with a wafer W placed on the transfer unit 36A or 36B, and where the detection device 12 detects that some malfunction has occurred in the wafer polishing apparatus 10A and judges that it has become impossible to continue thereafter the transfer, drying or inspection of the wafer W, the first control device 19 or the second control device 21 may output instructions to close the cover provided in the transfer unit 36A or 36B and fill with interior of the housing with a gas or liquid of low reactivity, such as an inert gas or pure water.

In a case where some trouble incapable of being coped with has occurred in the wafer polishing apparatus 10A, etc., the elimination of the trouble is entrusted to an operator by causing an alarm lamp to light or generating an alarm signal. When the operator of the wafer polishing apparatus 10A, etc., carries out the work of eliminating the trouble and this work has been finished, the operator cancels the error by operating an operation button or a touch panel provided in the wafer polishing apparatus 10A, etc., and gives instructions to restart polishing.

Then, the first control device 19 or the second control device 21 performs the handling of carrying the wafer W which is stored in the wafer storage chamber 90 or housed in the cassette 24 out to a step behind the step where the last handling was finished. In a case where the second control device is in charge of the control of the wafer polishing apparatus 10A and the handling has returned to its normal state, the second control device gives instructions to switch the control to the switchover device 23 and the first control device 19. Then, the control of the wafer polishing apparatus 10A is switched over to the first control device 19 and after that, the polishing and cleaning of the wafer W are carried out in a continuing manner on the basis of instructions from the first control device 19.

As described above, according to the polishing apparatus, polishing method and wafer evacuation program according to the present invention, there are provided a housing which shuts off a wafer from the outside air and an inert gas supply device which fills the inert gas into the housing. Therefore, it is possible to prevent the oxidation and modification of the wafer surface in each step, such as the polishing step, the transfer step after polishing, the cleaning step, the drying step, the inspection step and the storage step.

Furthermore, according to another aspect of the present invention, there are provided a wafer storage chamber, which temporarily stores a wafer and shuts off the wafer from the outside air, an inert substance filling device, which fills an inert substance, such as an inert gas and an inert liquid, into the wafer storage chamber, and a wafer carrying device, which carries a wafer into the wafer storage chamber. Therefore, it is possible to prevent the oxidation and modification of the wafer surface in each step, such as the polishing step, the transfer step after polishing, the cleaning step, the drying step, the inspection step and the storage step.

According to a further aspect of the present invention, the polishing apparatus is provided with a detection device which detects a trouble occurring in the polishing apparatus and the wafer carrying device carries a wafer into the wafer storage chamber when the detection devices detects a trouble occurring in the polishing apparatus. Therefore, even when a trouble occurs in the polishing apparatus, it becomes possible to prevent the retention of a wafer in a condition exposed to the atmospheric air during the polishing step, immediately after the polishing step, in the transfer step after polishing, the cleaning step, the drying step, the inspection step, the storage step, etc., thereby making it possible to prevent the oxidation and modification of wafer surfaces.

According to an additional aspect of the present invention, because ultrapure water containing dissolved oxygen of not less than 0.1 ppm and not more than 1 ppm or ultrapure water having a resistivity of not less than 16 MΩ and not more than 30 MΩ is used as the inert liquid to be used in the polishing apparatus, it becomes possible to prevent the oxidation and modification of the wafer surface at low cost.

According to an even further aspect of the present invention, there are provided a detection device which detects a trouble occurring in the polishing apparatus, a wafer storage chamber, which temporarily stores a wafer and shuts off the wafer from the outside air, an inert substance filling device, which fills an inert substance, such as an inert gas and an inert liquid, into the wafer storage chamber, a wafer carrying device, which carries a wafer into the wafer storage chamber, and a control device, which outputs an instruction to the wafer carrying device to carry a wafer into the wafer storage chamber when the detection device detects a trouble occurring in the polishing apparatus. Therefore, even when a trouble occurs in the polishing apparatus, it becomes possible to prevent the retention of a wafer during the polishing step, immediately after the polishing step, in the transfer step after polishing, the cleaning step, the drying step, the inspection step, the storage step, etc., thereby making it possible to prevent the oxidation and modification of wafer surfaces.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A polishing system, comprising:

a wafer working step part having a polishing pad on which a wafer is pressed to polish a surface of the wafer;

a wafer transfer step part;

a cleaning step part;

a rinse step part;

a drying step part;

an inspection step part, a storage part which stores the wafer after working a housing which encloses at least said wafer working step part and shuts off the wafer from outside air; and an inert gas supply device which fills an inert gas into the housing;

at least one control unit for monitoring operation of the polishing apparatus;

a wafer storage chamber associated with at least one of the wafer working step part, the wafer transfer step part, the cleaning step part, the rinse step part, the drying step part, the inspection step part, and the storage part; and a wafer transfer device which is operative for transferring a wafer from said at least one of the wafer working step part, the wafer transfer step part, the cleaning step part, the rinse step part, the drying step part, the inspection step part, and the storage part to said wafer storage chamber when said at least one control unit detects occurrence of a problem with respect to operation of the polishing apparatus.

2. A method of responding to the occurrence of a problem with respect to operation of a polishing apparatus comprising a housing which shuts off a wafer from an outside air and an inert gas supply device which fills an inert gas into the housing, the method comprising the steps of:

filling the inert gas into the housing;

at least one step of transferring, cleaning, rinsing, drying, and inspecting the wafer after working in the housing filled with the inert gas; and transferring a wafer from at least one of a wafer working step part, a wafer transfer step part, a cleaning step part, a rinse step part, a drying step part, a inspection step part, and a storage part to an associated wafer storage chamber when occurrence of a problem with respect to operation of the polishing apparatus is detected.

3. A polishing apparatus, comprising:

a polishing pad on which a wafer is pressed to polish a surface of the wafer;

a water storage chamber which temporarily stores the wafer to shut off the wafer from an outside air;

an inert substance filling device which fills an inert substance into the wafer storage chamber, the inert substance including at least one of an inert gas and an inert liquid;

a detection device which detects problems occurring in the polishing apparatus, and a wafer carrying device which carries the wafer into the wafer storage chamber;

wherein the wafer carrying device carries the wafer into the wafer storage chamber when the detection device detects trouble occurring in the polishing apparatus.

4. The polishing apparatus as defined in claim 3, wherein the wafer storage chamber is provided in one of interior and vicinity of at least one of a wafer working step part, a wafer transfer step part, a cleaning step part, a rinse step part, a drying step part, an inspection step part, and a storage part which stores the wafer after working.

5. The polishing apparatus as defined in claim 3, wherein the inert liquid is one of ultrapure water containing dissolved oxygen of not less than 0.1 ppm and not more than 1 ppm, and ultrapure water having a resistivity of not less than 16 MΩ and not more than 30 MΩ.

6. Polishing apparatus according to claim 3, wherein said detection device is adapted to detect at least one of the following types of problems:

trouble in the wafer polishing apparatus;

malfunctioning of the polishing pad, malfunctioning of a polishing platen, malfunctioning of a dressing device, malfunctioning in a transfer unit, a defect in the slurry and clean water to be supplied, malfunctioning of a transfer or indexing robot, malfunctioning during cleaning of a cleaning brush or the drive of the cleaning brush, shortage and clogging of cleaning liquid, or cleaning water to be supplied.

7. A control device of a polishing apparatus which polishes a surface of a wafer and comprises a wafer storage chamber which temporarily stores the wafer to shut off the wafer from an outside air; an inert substance filling device which fills an inert substance into the wafer storage chamber, the inert substance including at least one of an inert gas and an inert liquid; a wafer carrying device which carries the wafer into the wafer storage chamber; and the control device having a wafer evacuation program, and controlling the inert substance filling device and the wafer carrying device and monitoring operation thereof, wherein:

the wafer evacuation program enables the control device to control the inert substance filling device to fill the inert substance into the wafer storage chamber and the wafer carrying device to carry the wafer into the wafer storage chamber when the control device detects the trouble occurring in the polishing apparatus.

8. A method of responding to the occurrence of a problem with respect to operation of a polishing apparatus comprising a polishing pad on which a wafer is pressed to polish a surface of the wafer; a wafer storage chamber which temporarily stores the wafer to shut off the wafer from an outside air, an inert substance filling device which fills an inert substance into the wafer storage chamber, the inert substance including at least one of an inert gas and an inert liquid; a wafer carrying device which carries the wafer into the wafer storage chamber, the method comprising:

a step in which the inert substance filling device fills the inert substance into the wafer storage chamber; and a step in which the wafer carrying device carries the wafer into the wafer storage chamber;

wherein said steps are performed in response to detection of a problem with the operation of the polishing apparatus.

9. A polishing apparatus, comprising:

a polishing pad on which a wafer is pressed to polish a surface of the wafer;

a detection device which detects a trouble occurring operation of the polishing apparatus;

a wafer storage chamber which temporarily stores the wafer to shut off the wafer from an outside air;

an inert substance filling device which fills an inert substance into the wafer storage chamber, the inert substance including at least one of an inert gas and an inert liquid;

a wafer carrying device which carries the wafer into the wafer storage chamber; and a control device which outputs an instruction to the wafer carrying device to carry the wafer into the wafer storage chamber when the detection device detects the occurrence of trouble with respect to operation of the polishing apparatus.

* * * * *